United States Patent [19]

Sloan

[11] Patent Number: 4,979,322

[45] Date of Patent: Dec. 25, 1990

[54] APPARATUS AND METHOD FOR FORMING A CRATER IN MATERIAL BENEATH A BODY OF WATER

[75] Inventor: Albert H. Sloan, Ft. Lauderdale, Fla.

[73] Assignee: Subaqueous Services, Inc., Ft. Lauderdale, Fla.

[21] Appl. No.: 362,214

[22] Filed: Jun. 6, 1989

[51] Int. Cl.[5] ..... E02F 3/88

[52] U.S. Cl. ..... 37/65; 37/58; 405/74

[58] Field of Search ..... 37/58–63, 37/195, 64–67, 75–76; 405/74

[56] References Cited

U.S. PATENT DOCUMENTS

| | | | |
|---|---|---|---|
| 4,352,251 | 10/1982 | Sloan | 37/58 |
| 4,574,501 | 3/1986 | Sloan | 37/58 |
| 4,807,373 | 2/1989 | Sloan et al. | 37/58 X |
| 4,854,058 | 8/1989 | Sloan et al. | 37/58 X |

FOREIGN PATENT DOCUMENTS

| | | | |
|---|---|---|---|
| 158533 | 7/1986 | Japan | 37/58 |
| 138027 | 6/1988 | Japan | 37/65 |

*Primary Examiner*—Randolph A. Reese
*Assistant Examiner*—Franco S. DeLiGuori
*Attorney, Agent, or Firm*—Nilles & Nilles

[57] ABSTRACT

Dredging apparatus comprises a modular, submersible, vertically positionable crater sink mechanism operable to form a crater in a bed of material beneath a body of water. The crater sink mechanism comprises an elongated tubular housing closed at its upper end and having a dredged material intake opening at its lower end. An auger mounted within the housing is rotatable by a reversible hydraulic drive motor and is axially positionable by a linear hydraulic motor. The inner end of the auger cooperates with the closed end of the tubular housing to define a mixing chamber. A clear water inlet port and a mixture outlet port on opposite sides of the tubular housing each communicate with the mixing chamber. The auger is rotatable in one direction to dig into and ingest material (fluidized by ambient water) through the material intake opening and transport it into the mixing chamber. A pump is connected to either one or both of the ports to effect flow of clear water (from the body of water) through the clear water inlet port into the mixing chamber wherein it mixes with ingested dredged material and to effect expulsion of the mixture from the mixing chamber through the mixture outlet port. Fluid pressure in the mixing chamber relative to that of the ambient water is determined by pump location and/or by the shape of the mixing chamber and its port. Fluid pressure is such as to prevent pressure-induced induction or expulsion of dredged material through the material intake opening. A jet nozzle near the material intake opening supplies clear water to further fluidize ingested material. Clear water is also supplied to clean anti-friction bearings supporting the auger. A control unit including a sensor causes momentary reverse rotation of the auger to expel ingested foreign matter which interferes with normal auger operation.

13 Claims, 5 Drawing Sheets

23
183
182
202
198
26
51
196
180
185
200
50
197
160
188
187
186
165
164
44
161
135
54
52
154
48
130
132
134
136
102
58
100
60
40
46
146
103
42
116
105
110
131
118
56
100
46
146
148
158
150
152
154
155
156
144
122
115
120
108
112

APPARATUS AND METHOD FOR FORMING A CRATER IN MATERIAL BENEATH A BODY OF WATER

BACKGROUND OF THE INVENTION

1. Field of Use

This invention relates generally to improved apparatus and methods for forming a crater in a bed of material beneath a body of water.

In particular, the improved apparatus includes an improved submersible crater sink mechanism, control means therefor and pump means for use therewith. The improved methods relate to operating the improved crater sink mechanism.

2. Description of the Prior Art

The prior art contains various apparatuses and mechanisms for use in underwater dredging systems to form a crater in a bed of material underlying a body of water.

As prior art FIGS. 11 and 12 hereof show, some dredging systems employ a prior art submersible jet pump which is located at an underwater site where a crater is to be formed and is connected by hoses to a clear water supply pump and to a booster discharge pump, both pumps usually located on a nearby shore. A typical prior art jet pump takes the form of a tubular housing defining a chamber having a constricted, nozzle-like clear water inlet port at one end, an expanded, larger diameter discharge port at its opposite end and a suction port in a side thereof intermediate the other two ports. A suction tube for ingesting dredged material has one end connected to the suction port and has its opposite end disposed against the bed of material. The discharge port is connected to the discharge booster pump. The clear water inlet port is supplied with clear water at high pressure from the water supply pump. Thus, the chamber functions like a venturi tube in that the increase in velocity of the clear water flowing therethrough is accompanied by a proportional decrease in hydraulic pressure. This results in fluidized dredged material, i.e. a mixture of material from the bed and ambient water, flowing into and through the suction tube and into the chamber wherein it mixes with clear water and this mixture is expelled through the discharge port to the discharge booster pump for ultimate delivery to a disposal site. Such prior art jet pumps rely solely on the negative pressure differential between the fluid in the chamber and the body of water in which the jet pump is submerged to effect ingestion of dredged material into the chamber and are very inefficient, requiring several pumps and a large power input to the clear water pump and booster pumps for effective dredging operations, i.e. on the order of 500 hp or greater, for example.

Use of the prior art jet pump hereinbefore described (and other types of suction pumps) is accompanied by several problems. If, for example, in order to pump sand the inlet (suction) hose is merely lowered to the bed of material, several possibilities can occur; (1) the pump will have near zero production, pumping water only; (2) the pump will move a little sand at first and then taper off to near zero production thereafter; (3) the pump will have a high production rate to start with and then taper off to near zero output thereafter; (4) the pump will start with little production and increase steadily until the system plugs up; (5) the pump will not produce at the proper ratio of sand to water to ensure proper mixture flow. Items 1 through 3 above result in serious economic consequences from lost production. Item 4 causes very serious mechanical and logistical problems and the pump will be in a self-destruct mode and vast amounts of time and effort will be required to unplug the lines. Regarding item 5, the proper ratio does not occur as a natural event. The dredging industry accomplishes this feat by means of many accessories to support and move the dredge pump and, ultimately, the suction end thereof. However, this will still not get the job done without the direction of a human operator who increases or decreases the percentage of solids by manipulating the suction of the pump. Left unattended, the system will revert to conditions 1 through 3. The problem of line plugging is of paramount importance when the pipe line is buried, such as under inlets. Great expense and engineering expertise are required to surmount this event.

My U.S. Pat. No. 4,574,501 issued Mar. 11, 1986 entitled "In-Place Underwater Dredging Apparatus of the Crater Sink Type" discloses in-place underwater dredging apparatus for dredging solid particulate matter from an underwater site to clear a channel thereat, mixing it with dirty or dredge water, pumping the mixture from the site by means of a built-in pump and discharging it at a remote location.

My prior art apparatus comprises a housing shaped like an inverted "T" formed by a horizontal tube open at both ends and an upstanding vertical tube connected intermediate the ends which defines a mixing chamber. A hydraulically driven pump is mounted on the upper end of the vertical tube and has a discharge conduit for conducting the mixture to the remote location. Motor-driven rotatable augers are disposed in opposite ends of the horizontal tube and extend generally laterally outwardly from the lower end of the upstanding tube. The augers operate to deliver solid particulate matter at a selected rate to the mixing chamber in the upstanding tube. A dirty or dredge water inlet port is provided in the horizontal tube of the housing intermediate the inner end of the augers and is connected to a dirty water inlet pipe. During a dredging operation the pump draws a mixture comprising solid particulate material from the augers and dirty water entering the dredge water inlet port through the upstanding tube and discharges the mixture at the remote location. The dirty water fluidizes the material fed from the augers, thereby enabling it to be more easily handled by the pump. A clear water intake pipe, including a shut-off valve, is connected to a clear water inlet port located near the upper end of the upstanding tube for admitting clear water thereby insuring that the apparatus is clean before starting and can be purged after use. However, the valve is closed during a dredging operation and no clear water is admitted to the chamber during dredging.

In my prior art apparatus the ends of the horizontal tube extend radially outwardly from the lower end of the vertical tube in a generally horizontal direction and the apparatus, when submerged, is designed and constructed to rest in a fixed location on the bed beneath the body of water and can be started whenever desirable, i.e. after solids have accumulated to a certain depth on the bed, to thereby again clear the site to the desired level. The apparatus remains at a fixed depth, i.e. on the original bed surface, and does not sink deeper as dredging occurs. Generally, the apparatus is installed at the site while the area is clean and is positioned at its desired depth. Thereafter, the apparatus can be left in place (in situ) and operated whenever the solid particulate matter rises to a level above the floor which necessitates its removal. A stabilizing mounting structure including metal plates are secured to and extend transversely across the bottom of the horizontal tube of the housing so as to provide stability and prevent its shifting, tilting or sinking downward below its desired fixed depth.

My prior art apparatus contemplates a hydraulic fluid power source which can be located remotely from the site to be dredged, as for example, up on the adjacent shore or on a barge. This power source has hydraulic fluid lines connecting its fluid pressure pump with the hydraulic pump mounted on top of the upstanding tube of the apparatus and also with a hydraulic motor that drives the auger screws.

SUMMARY OF THE PRESENT INVENTION

The present invention provides an improved apparatus and methods for use in a dredging system to form a crater in a bed of material beneath a body of water. The apparatus comprises an improved crater sink mechanism, control means therefor and pump means for use therewith.

The crater sink mechanism generally comprises a housing defining a chamber having a clear water inlet port, a mixture outlet port and a material intake opening for disposition beneath and in communication with the body of water and adjacent the bed. The mechanism further comprises transport means, such as a motor-driven auger, on the housing near the material intake opening and operable to dig into the bed to dislodge material therefrom and to transport the dislodged material (initially fluidized by ambient water) through the material intake opening into the chamber. Preferably, the housing takes the form of an elongated tube closed at one end and open at its other end, which open end serves as the material intake opening. In use, the tubular housing is generally vertically disposed (straight or slanted) so that the material intake opening confronts the bed and the outer end of the auger extends therefrom to engage and dig into the bed. The ports are located on opposite sides of the tubular housing adjacent the chamber which is located between the inner end of the auger and the closed end of the tubular housing. The housing may be partially or completely submerged in the body of water.

The apparatus further comprises pump means, physically separated from and not part of the crater sink mechanism per se, connected to the clear water inlet port or to the mixture outlet port or to both ports. The pump means is operable to effect flow of clear water through the clear water inlet port into the chamber for mixing with material in the chamber to form a mixture and to effect flow of the mixture from the chamber through the mixture outlet port.

The apparatus operates so as to prevent self-induction of dislodged material through the material intake opening, which would result in loss of control of the amount of material entering the chamber (which is fed at a constant rate by the auger) and, therefore, upset a desired or optimum ratio of material and clear water in the mixture which is necessary to achieve and assure proper mixture flow to a disposal site.

The apparatus further operates so as to prevent flow or blow-out from the chamber through the material intake opening of clear water entering the chamber or the mixture already in the chamber or dislodged material in the material intake opening, any of which events would prevent entry of adequate and desired amounts of material.

Prevention of self-induction and/or blow-out depends on establishing and maintaining a predetermined relationship between the hydraulic pressure of the fluid (i.e., either clean water or the mixture) in the chamber and the ambient hydrostatic pressure in the ambient body of water with which the material intake port communicates. A zero differential between these pressures is ideal for maximum control. However, the apparatus operates satisfactorily if the hydraulic pressure in the chamber is either slightly higher or lower, within certain limits, than the ambient hydrostatic pressure. However, these limits are reached when hydraulic pressure in the chamber is high enough (positive) relative to ambient hydrostatic pressure to cause the aforementioned blow-out, or when hydraulic pressure in the chamber is low enough (negative) relative to ambient hydrostatic pressure to cause undesired, pressure-induced material induction which results in the aforementioned loss of control of the amount of material entering the chamber and upsets the desired ratio.

Establishing and maintaining the aforesaid predetermined relationship between hydraulic pressure in the chamber and the ambient hydrostatic pressure of the body of water can be accomplished in several ways. Such ways include location of the pump means in the apparatus; design, shape and construction of the chamber and the inlet and outlet ports therefor in the crater sink mechanism; the method of operating the pump means; or various combinations thereof.

Several embodiments of the invention are disclosed in detail herein. In all embodiments, however, the pressure ratio between the hydraulic pressure the chamber and the ambient hydrostatic pressure of the body of water is within the limits hereinbefore described.

In one embodiment, the pump means of the apparatus comprises one pump, namely a motor-driven clear water supply pump connected to the clear water inlet port of the crater sink mechanism. Furthermore, the crater sink mechanism is constructed so as to have a flow-constricting nozzle at the clear water inlet port and an enlarged mixture outlet port so that the flow conditions and pressure in the chamber prevent clear water entering the chamber from flowing out through the material intake opening, i.e., a blow-out condition.

In a second embodiment, the pump means of the apparatus comprises one pump, namely, a motor-driven dredge pump connected to the mixture outlet port of the crater sink mechanism. Preferably, the dredge pump is located as close as practical to the mixture outlet port to increase efficiency.

In a third embodiment, the pump means of the apparatus comprises two pumps, namely, the aforesaid dredge pump connected to the mixture outlet port and the aforesaid clear water supply pump connected to the clear water inlet port of the crater sink mechanism. The ports and chamber are also designed and constructed, as above-described, to maintain desired flow and pressure conditions therethrough. However, special port and chamber design can be avoided if flow rates of the two pumps are balanced so that hydraulic pressure in the chamber is within the aforementioned limits.

The transport means disclosed in the several embodiments comprises a motor-driven auger rotatably mounted in the tubular housing. Preferably, the auger is reversiby rotatable and is also adjustably positionable axially in the material intake opening at the open end of the tubular housing.

In the preferred embodiments water pipes or passages are provided on the housing to supply clear water under pressure by means of a small pump from a suitable source to a jet nozzle located near the material intake opening at the lower end of the housing and to bearing means which rotatably and slidably support the lower end of the auger. The jet nozzle supplies clear water to further fluidize the material entering the material intake opening which is already fluidized to a limited extent by ambient water. Clear water is supplied to the bearing means to keep them clean of abrasives and thereby prolong bearing life.

First and second motors are mounted on the housing to operate the auger and are controlled by a control means in accordance with the invention. The first motor selectively rotates the auger in forward (ingesting) and reverse (expulsion) directions about its longitudinal axis. The second motor selectively shifts the auger axially inwardly or outwardly relative to the material intake opening to regulate the quantity of ingested material.

The crater sink mechanism and its control means are part of dredging apparatus which also comprises the discharge pump and the clear water supply pump, whichever are used. The apparatus also comprises a power supply source located remotely from the crater sink mechanism. The power supply source furnishes operating power to operate the two motors of the crater sink mechanism and the motors of the various pumps. The motors are disclosed as hydraulically operated but could take the form of suitable electric or pneumatic motors connected to a suitable power source.

In use, the crater sink mechanism, with its tubular housing vertically disposed, is lowered into the bed of material at an underwater site where a crater is to be dug either by means of a releasable flotation device or by a mobile crane located onshore or on a barge. If prefereed, the crater sink mechanism can be mounted on a piling at some fixed location by means which allow it to be raised and lowered as desired. When in operation, the crater sink mechanism ingests and digs vertically downward into the material forming the bed, thereby forming an ever-deepening crater and, at the same time, descending downwardly with the floor of the crater being formed.

In operation, clear water is supplied through a clear water hose connected to the clear water inlet port of the mixing chamber in the crater sink mechanism. A small amount of clear water is also supplied under pressure by the small pump from a suitable source through the water passages or pipes to the jet nozzle and to the auger bearing means. Clear water from the jet nozzle further fluidizes the material being handled by the auger. Clear water to the bearing clears it of debris and prolongs its life. Clear water entering the mixing chamber through the clear water inlet port mixes therein with material dislodged and ingested by the rotating auger from the dredging site, after being fluidized by ambient water and by clear water from the jet nozzle. The mixture comprising fluidized ingested material supplied by the auger and clear water entering from the clear water inlet port is expelled from the mixing chamber through the mixture outlet port and through a discharge hose to a remote disposal site, such as an onshore containment area, or into a transport vehicle, such as a dump truck located on-shore or a floating barge.

The control means effect operation of the auger in the forward direction at a desired rotational speed to control the rate at which material is ingested. The control means also includes sensing means to effect momentary reverse rotation of the auger when unduly large foreign material or objects, such as branches, sticks, large rocks, wire or the like, are ingested and interfere with auger rotation. The control means also operates to stop auger rotation (or issue a warning signal or both) if such foreign objects are repeatedly ingested within a short span of time. The control means are also selectively operable to effect extension and retraction of the auger from the opening in the housing to control the rate of digging, i.e. material ingestion.

The improved dredging apparatus, the crater sink mechanism and the methods of operation in accordance with the present invention offer several advantages over the prior-art, and especially jet pumps and my above-described prior-art dredging apparatus.

For example, the improved apparatus in its simplest form comprises a minimum number of components, namely, the improved crater sink mechanism and a single independently operable dredge pump connected to the mixture outlet port of the crater sink mechanism, as compared to the two (water supply and booster) pumps required in typical prior-art jet pump type dredging systems of comparable dredging capacity. Furthermore, the improved crater sink mechanism employs motor-driven transport means, such as an auger, to convey material to the mixing chamber and does not depend on pressure-induced induction to ingest dredged material as in the case of prior art jet pumps. Therefore, the crater sink mechanism is substantially more efficient and requires less power input. For example, tests of an actual crater sink mechanism in accordance with the invention and having a tubular housing on the order of ten feet long with a one-foot inside diameter employed a 150 hp discharge pump, whereas a prior-art jet pump system of comparable capacity required a total power input to its two pumps of about 500 hp.

The improved crater sink operates automatically to dig a vertical crater, unlike the device described in my Pat. No. 4,574,501 which remains at a fixed level and unlike prior-art hand-held dredges which must be physically directed by a diver to aim them in the right direction (i.e., vertically) to dig a crater.

Furthermore, prior art jet pumps must be manipulated by the diver to control the ratio of the water/solid matter mixture being ingested in order to ensure proper flow and prevent solids from settling out and clogging the dredge and associated hoses. However, in the improved crater sink mechanism, the proper ratio is obtained by remotely controlling the rotational speed of the auger, or the extent to which the auger axially projects from the opening in the housing, or the rate of flow of clear water from the clear water pump into the mixing chamber, or some combination thereof. The improved crater sink mechanism does not require any complex valves thereon to control the rate of flow of water into the mixing chamber, as is the case in some prior art dredge heads and crater sink mechanisms.

Unlike some prior art dredges and my prior art crater sink mechanism, the improved crater sink mechanism employs clear water delivered into the mixing chamber, instead of dirty, debris-filled, dredge water drawn from the immediate vicinity of the crater, and this enables much better control of the mixture ratio to obtain more efficient and trouble-free operation. Use of clear water also facilitates flushing of the mixing chamber, the auger and the auger bearing when the auger is stopped. Clear water is also injected by the jet nozzle near the material intake opening to facilitate material ingestion and is also supplied to the auger bearing means to prolong bearing life.

Furthermore, the auger is precisely controllable by the control means, both as regards speed of rotation and amount of extension from the housing, and can deliver solid material at a desired uniform rate. The control means operates to automatically reverse rotation of the auger to clear it of ingested obstructing debris and warns the operator and/or shuts down the crater sink mechanism to prevent damage if debris is repeatedly ingested in a short time-span.

The crater sink mechanism is simple in design and construction, and because of it modular construction, is easy and economical to fabricate and service.

Other objects and advantages will hereinafter appear.

DRAWINGS

FIG. 1 is a schematic diagram of underwater dredging apparatus employing a crater sink mechanism in accordance with one embodiment of the present invention;

Fig. 1A an enlarged cross-section view of a portion of the crater sink mechanism of FIG. 1;

DESCRIPTION OF PREFERRED EMBODIMENTS GENERAL CONSIDERATIONS

Figure 1:
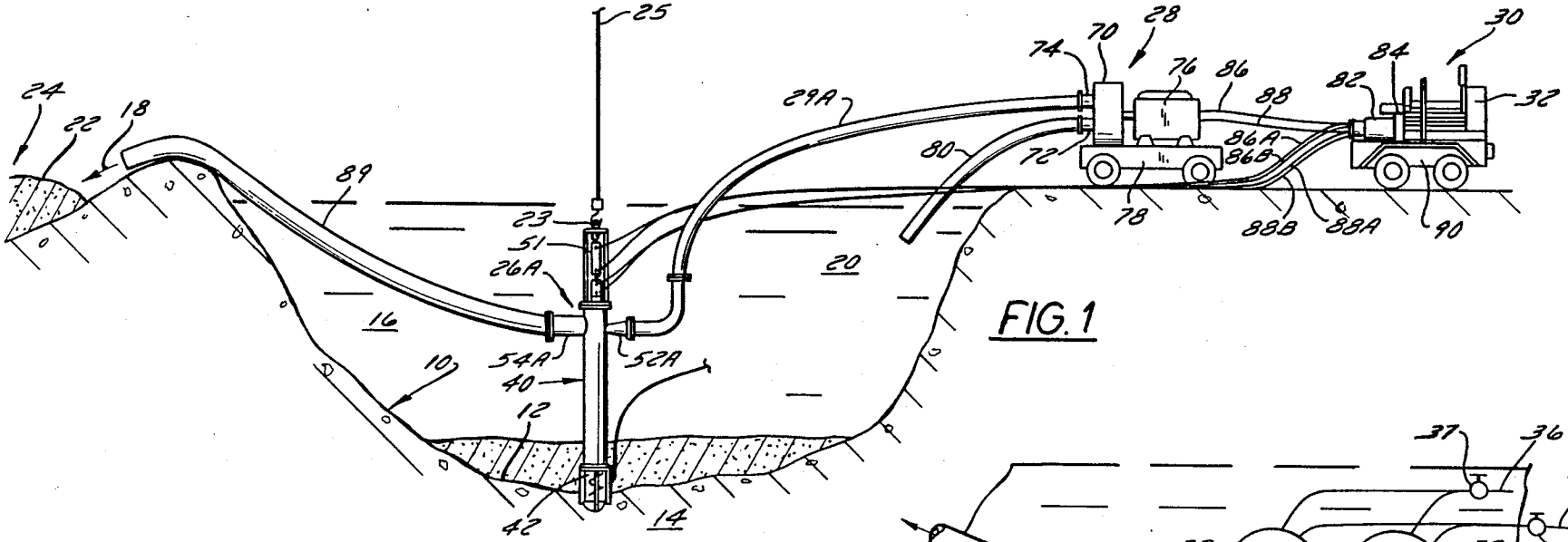
Fig. 1O is a perspective view of the upper end of the crater sink mechanism of FIGS. 8 and 9.

Three different embodiments of crater sink mechanisms are depicted herein and are designated 26 (FIGS. 2, 3, 4, 5, 6 and 7); 26A (FIGS. 1, 1A and 2B); and 26B (FIGS. 2A, 8, 9 and 10). All are generally similar in construction and similar components are identified by the same reference numerals, except as otherwise noted hereinafter.

Figure 2:
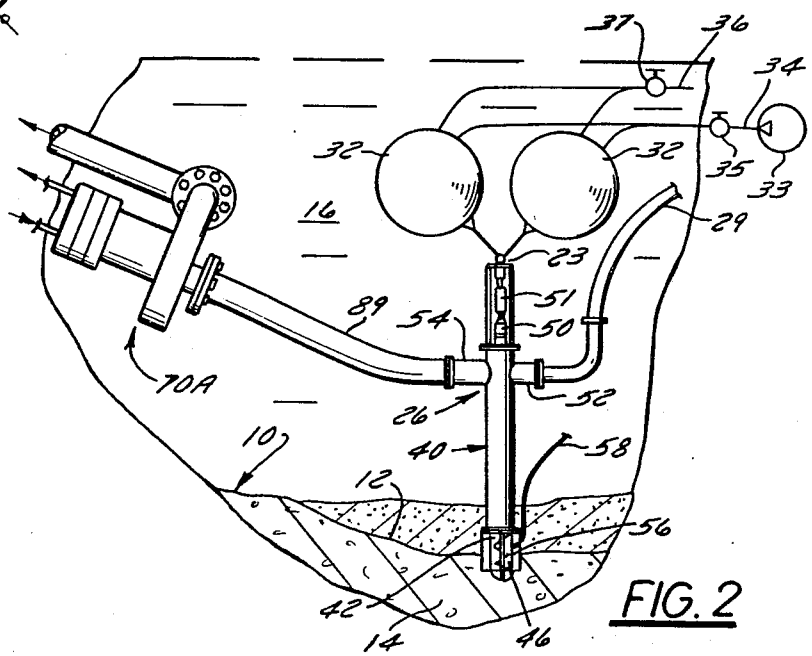
FIG. 2 is a schematic diagram of underwater dredging apparatus in accordance with another embodiment of the present invention employing a crater sink mechanism and showing a flotation device for raising and lowering the crater sink mechanism.
Figure 2B:
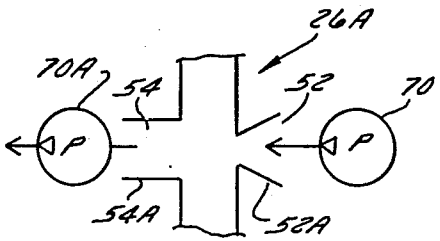
FIG. 2B is a schematic diagram of still another embodiment of a crater sink mechanism according to the invention.
Figure 2A:
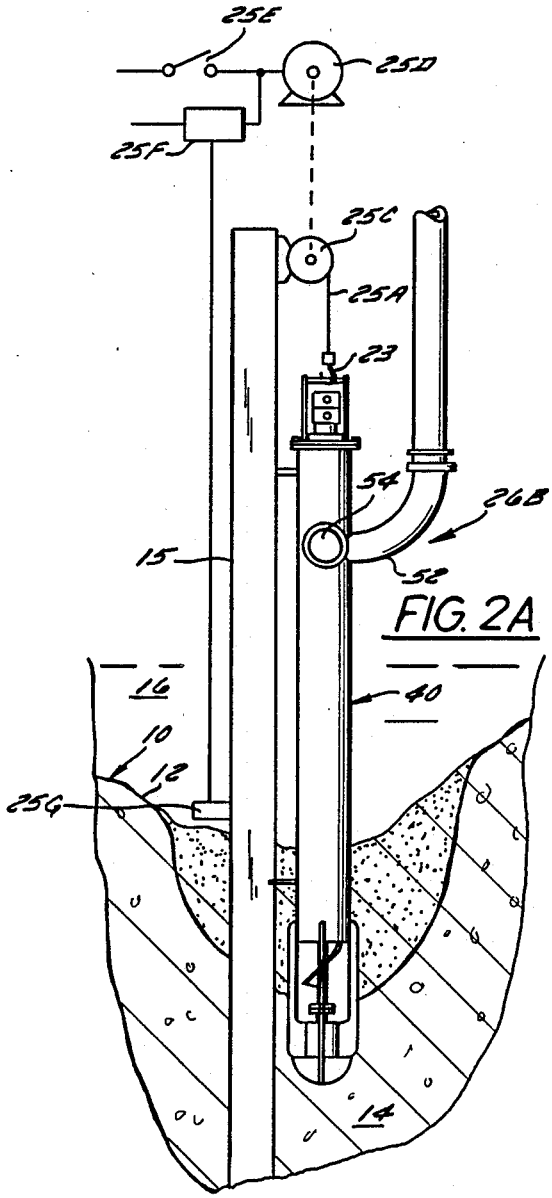
FIG. 2A is a schematic view showing another means of raising and lowering a crater sink mechanism at a fixed dredge site.

Referring to FIGS. 1, 2 and 2A each crater sink mechanism 26, 26A and 26B operates in its respective underwater dredging system, and in conjunction with other apparatus such as pump means, to form an underwater crater 10 in a bed 12 of particulate material 14, such as sand or silt, lying beneath a body of water 16 and, as FIG. 1 shows, to dispose of the dredged material 22 displaced from the crater at a disposal site 24, such as a remote on-shore containment area.

Furthermore, each crater sink mechanism 26, 26A and 26B comprises an elongated tubular housing 40 and is adapted to be lowered into the body of water 16 for vertical orientation relative to bed 12 and subsequently raised by any suitable emplacement/removal means, such as a crane (see FIG. 1), a flotation device (see FIG. 2), or a winch (see FIG. 2A), are hereinafter explained.

Each crater sink mechanism 26, 26A and 26B comprises a mixing chamber 48 having a clear water inlet port 52 and a mixture outlet port 54. However, in crater sink mechanism 26A depicted in FIGS. 1, 1A, and 2B, the clear water inlet port takes the form of (or includes) a flow constricting or eductor nozzle 52A and the mixture outlet port takes the form of (or includes) a relatively wide flow expansion nozzle 54A.

Figure 7:
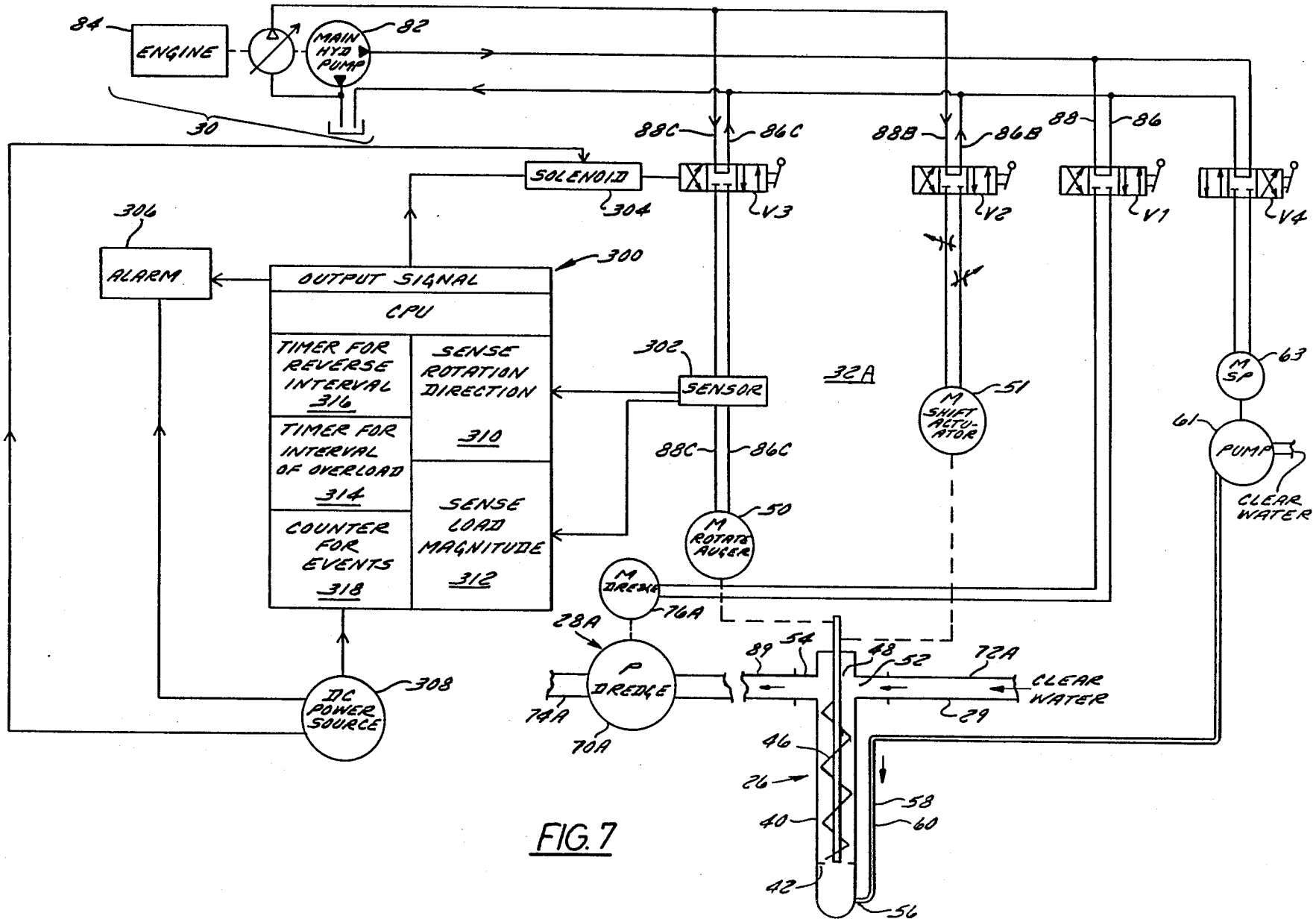
FIG. 7 is a schematic diagram of a dredging system employing the crater sink mechanism of FIGS. 2 through 6 and the control means therefor.

Crater sink mechanisms 26 and 26B do not employ flow constricting eductor nozzles 52A and expansion nozzles 54A and each is employed in a system wherein a dredge pump 70A is connected to the mixture outlet port 54 of the crater sink mechanism to effect clear water flow through the clear water inlet port 52 into mixing chamber 48 and to effect expulsion of the mixture from mixture outlet port 54, as FIGS. 2 and 7 show.

On the other hand, crater sink mechanisms 26A, which does employ a flow constricting eductor nozzle 52A and an expansion nozzle 54A, is employed in either a system (see FIG. 1) wherein a water supply pump 70 is connected to the clear water inlet port 52, or in a system (see FIG. 2B) wherein a water supply pump 70 is connected to the clear water inlet port 52 and a dredge pump 70A is connected to mixture outlet port 54.

Crater sink mechanisms 26 and 26A each have an axially positionable auger, whereas crater sink mechanism 26B does not.

EMPLACEMENT/REMOVAL MEANS

Each crater sink mechanism 26, 26A and 26B has an eyelet 23 or similar structure attached to the upper end of its housing 40.

As FIG. 1 shows, eyelet 23 of crater sink mechanism 26A is attached to a load-line 25 of a mobile crater (not shown) located on shore or on a floating barge (not shown) and which operates to lower and raise the crater sink mechanism.

As FIG. 2A shows, eyelet 23 of crater sink mechanism 26B is attached to and suspended from the end of a winch cable 25A and is slidably mounted on piling 15 which is understood to be rigidly supported in bed 12 at a fixed location. The other end of cable 25A is attached to a winch 25C secured to piling 15 which is selectively rotatable in raise or lower directions by means of a reversible motor 25D, for example. When bed 12 builds up to a certain level at the base of piling 15, crater sink mechanism 26B can be lowered by operation of winch 25C into the body of water 16 and into contact with the material to be dredged and then operated to effect removal of the build-up. The crater sink mechanism 26B can be lowered as necessary so as to descend with the receding surface of the bed as dredging occurs and can be stopped and can be raised when desired. Winch motor 25D may be under the control of a manually operable switch 25E or an automatic electric control unit 25F which, for example, comprises a level detecting sensor 25G on piling 15.

As FIG. 2 shows, eyelet 23 of crater sink mechanism 26 is releasably attached to flotation means comprising a pair of inflatable/deflatable air bags 32 of sufficient size, when fully inflated, to float and support crater sink mechanism 26. The air bags 32 are supplied with compressed air from an air pump 33 through a detachable hose 34 which has a manually-operable on-off valve 25 therein. Air is expelled from the air bags 32 by means of a detachable hose 36 having a manually-operable on-off valve 37 therein. In use, crater sink mechanism 26 with air bags 32 attached and inflated is moved on the surface of the body of water 16 (by a boat or swimmer, neither shown) to the dredge site, a diver (not shown) opens valve 37 to release some air from the air bags 32 and, as the mechanism 26 sinks, the diver guides the mechanism underwater to a specific point at the dredge site. Thus, when the lower end of mechanism 26 is precisely located, the air bags 32 are fully deflated by opening valve 37 and the mechanism sinks into and sets itself at the dredge site. Thereafter, the fully deflated air bags 32 are detached from eyelet 23 on crater sink mechanism 26 (and from air hose 34, if desired) and taken to the surface by the diver. Crater sink mechanism 26 is recovered by having the diver re-attach the deflated air bags 32 to eyelet 23 underwater, re-connecting compressed air hose 34, if necessary, and inflating the air bags by opening valve 35, whereupon the mechanism 26, with air bags 32 attached floats to the surface for recovery.

CRATER SINK MECHANISMS

Referring to FIGS. 2 through 7, crater sink mechanism 26 comprises a tubular housing 40 having an opening 42 at one (lower) end and closed at its opposite (upper) end by an upper end plate 44. Housing 40 is adapted for vertical disposition when in use so that opening 42 is at the lower end of housing 40 and confronts bed 12. An auger 46 is mounted in housing 40 near opening 42 and cooperates with the housing to define a mixing chamber 48 between the upper end of auger 46 and end plate 44 of the housing.

A hydraulically operated reversible rotatable motor 50 is mounted on housing 40 to rotate auger 46 in one direction whereby the auger ingests material 14 from bed 12 and transports the ingested material through opening 42 to mixing chamber 48.

Figures 3, 4, 5:
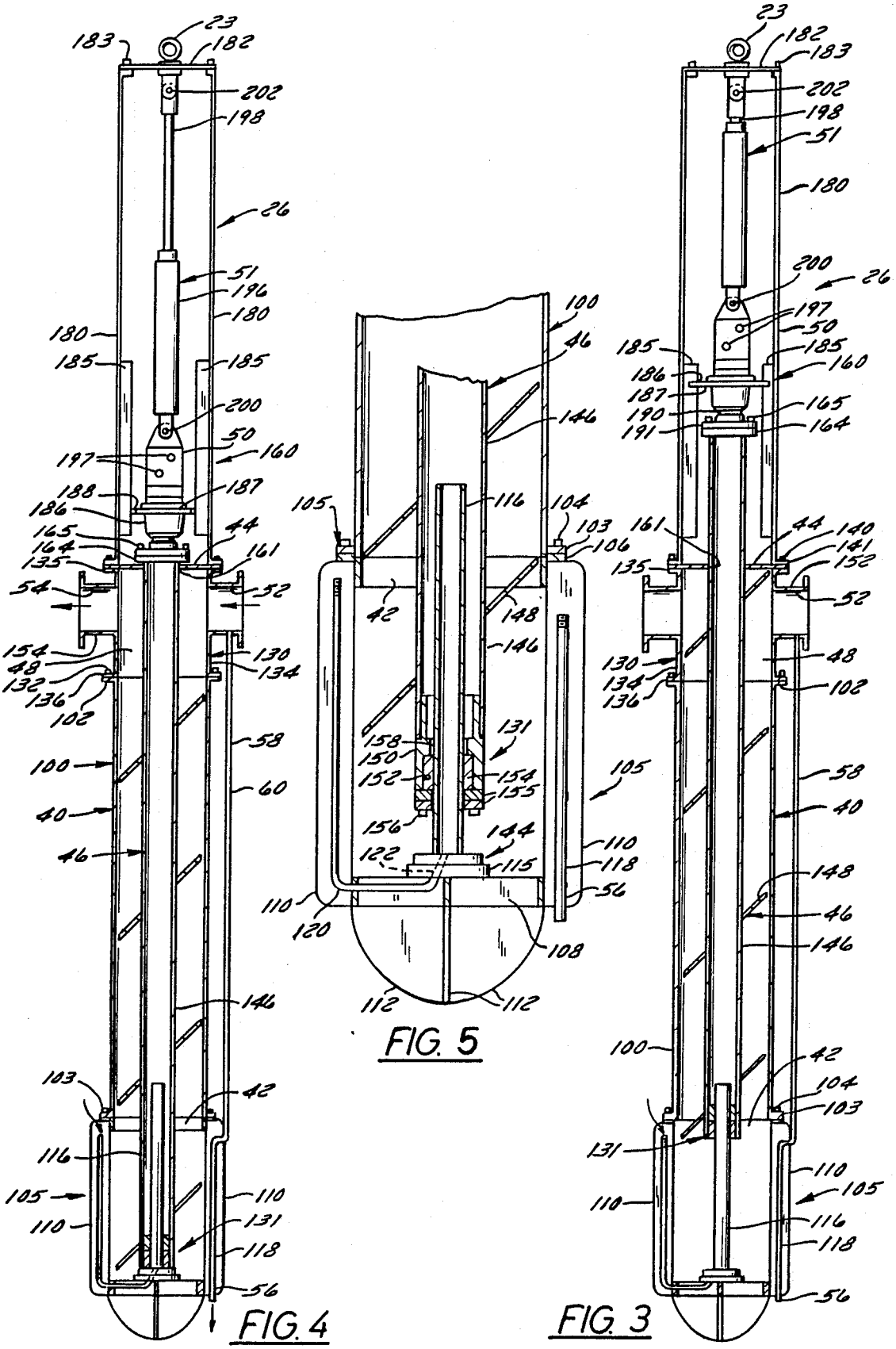
FIG. 3 is a enlarged cross-section view of the crater sink mechanism of FIG. 2 showing it in vertical disposition and showing the auger fully retracted.
FIG. 4 is a view similar to FIG. 3 but showing the auger fully extended.
FIG. 5 is an enlarged view of the lower end of the crater sink mechanism of FIGS. 3 and 4 and showing the auger partially extended.

Another hydraulically operated extendable/retractable motor 51 is mounted on housing 40 to selectively move auger 46 axially to any position between fully retracted position (FIG. 3) and fully extended position (FIG. 4).

A clear water inlet port 52 is provided on housing 40 and communicates with mixing chamber 48 for admitting clear water 20 through a hose 29 (see FIGS. 2 and 7) into chamber 48 for mixing therein with ingested material 14 in the chamber to provide a mixture 18 of clear water 20 and ingested material 14. Hose 29 is in direct communication with the body of water 16 and is not connected to a pump. A mixture outlet port 54 is provided on housing 40 and communicates with mixing chamber 48 and mixture 18 is expelled therethrough from mixing chamber 48 through a hose 89 which is connected to a pump 70A which delivers it to containment area 24 whereat the water drains away and dredged material 22 remains as a residue in the same manner as shown in FIG. 1 in connection with crater sink mechanism 26A.

Crater sink mechanism 26 further comprises a jet nozzle 56 located near opening 42 in housing 40 and a pipe or hose 58 mounted on housing 40 defining a passage 60 to supply a small portion of clear water under pressure from a small water pump 61 (see FIG. 7) to jet nozzle 56 for injection into material 22 being ingested by auger 46 to fluidize the ingested material and facilitate its transport by the auger upward within the housing to mixing chamber 48.

During operation, as FIG. 2 shows, crater sink mechanism 26 ingests the material 14 beneath the lower end thereof to thereby form crater 10, while at the same time sinking downward with and into the floor of the crater as the latter is being formed. Because it operates in a hostile environment and certain components therein are subjected to severe abrasion and wear during use and occasionally need replacement, crater sink mechanism 26 is of modular design and construction and is relatively easy to assemble and disassemble merely by removing bolts.

Thus, referring to FIGS. 3, 4 and 5 tubular housing 40 comprises a steel main tube 100 which in an actual embodiment which was tested was about ten feet long with a one foot inside diameter, but which could be of any suitable size; a cage assembly 105; a chamber assembly 130; and a motor support assembly 160. The upper and lower ends of main tube 100 have flanges 103 and 102, respectively, welded thereto.

Cage assembly 105 is detachably connected to lower flange 103 by bolts 104 and serves to protect the lower end of auger 46, while at the same time admitting dredged material 14 into opening 42 of main tube 100 but preventing entry of extraordinarily large objects, such as sticks, stones and other debris. Referring to FIG. 5, cage assembly 105, fabricated of steel, comprises an upper annular member or flange 106, a lower circular plate 108, and four elongated cage bars 110 welded between upper member 106 and lower plate 108 in 90° spaced apart relationship to allow auger 46 to have access to the material 14 in bed 12. However, a greater or smaller number of cage bars 110 could be provided, depending on the size of material intake opening 42. Four plates 112, spaced 90° apart from each other, are welded to the underside of lower plate 108 to define a spade-like structure which facilitates entry of crater sink mechanism 26 into bed 12.

As FIG. 5 shows, cage assembly 105 also comprises a support structure 144 for the lower end of rotatable and axially shiftable auger 46. Structure 144 comprises a base plate 115 welded to the upper side of plate 108 and a hollow tube 116 welded thereon. Cage assembly 105 also provides support for jet nozzle 56 which takes the form of a metal pipe 118, threaded at its upper end for releasable connection to pipe 58, which supplies clear water for injection by the jet nozzle near opening 42 at the lower end of main tube 100 to fluidize incoming material 14. Pipe 118 is welded to one of the cage bars 110. Another pipe 120, threaded at its upper end for releasable connection to pipe 58, is welded to another cage bar 110 and has its lower end connected to a passage 122 in base plate 115 to supply clear water to the interior of hollow tube 116 to lubricate a bearing assembly 131, hereafter described, at the lower end of auger 46.

Referring to FIG. 4, chamber assembly 130 is detachably connected to upper flange 102 of main tube 100 by bolts 132 and serves to define mixing chamber 48 and provide support for the conduit 152 for clear water inlet port 52 and the mixture outlet conduit 154 for mixture outlet port 54 (see FIG. 1). Chamber assembly 130, preferably fabricated of wear-resistant corrosion-proof stainless steel, takes the form of a short tube 134 having upper and lower flanges 135 and 136, respectively, and ports on opposite sides thereof at which short, flanged lateral tubes 152 and 154 are welded. Lower flange 136 is secured by the bolts 132 to upper flange 102 of main tube 100. Upper flange 135 is secured by bolts 140 to a lower flange 141 on motor support assembly 160.

Referring to FIGS. 3, 4 and 5, auger 46 comprises a hollow steel auger shaft 146 on and around which a helical steel auger blade 148 is welded. The diameter of auger blade 148 is slightly less than the inside diameter of main tube 100 so that ingestion is efficient and mixing chamber 48 is relatively well-sealed during auger rotation. The lower end of auger shaft 146 is provided with the bearing assembly 131 which slidably and rotatably accomodates tube 116 on cage assembly 105. Bearing assembly 131 comprises a bearing support cup 150 welded to the end of auger shaft 146. Cup 150 has a recess 152 therein for receiving an annular shaped bearing 254 which is secured in recess 152 by a washer and a cover plate 155. Cover plate 155 is detachably secured to cup 150 by bolts 156 so as to secure bearing 154 in place but allows for its replacement when worn out. Bearing 254 is flushed of sand and silt by clear water which flows from pipe 120 through passage 122, through the interior of tube 116 and overflows therefrom into the interior of hollow shaft 146 and through a shaft clearance space 158 in cup 150 onto the inner surface of bearing 254.

Referring to FIGS. 3 and 4, the upper end of auger shaft 146 extends through a hole 161 in end plate 44 which is bolted to the upper end of main tube 100. Hole 161 is sized to allow for axial and rotational movement of auger shaft 146 but is small enough to prevent undue leakage from mixing chamber 48. The upper end of auger shaft 146 has a flange 164 welded thereto for receiving bolts 165 which releasably connect the auger shaft to the motors 50 and 51.

Figure 6:
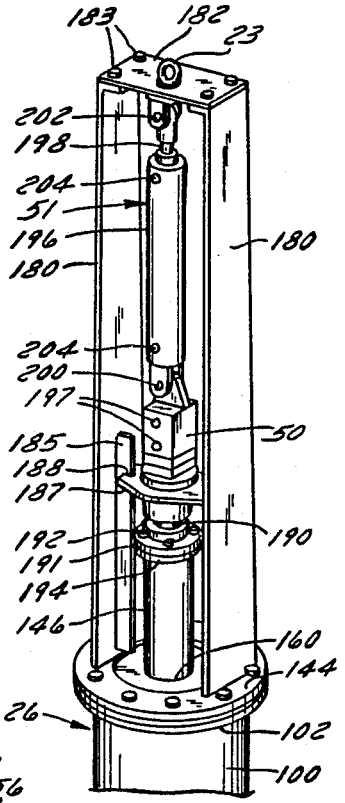
FIG. 6 is a perspective view of the upper end of the crater sink mechanism of FIGS. 2 through 5.

Referring to FIGS. 3, 4 and 6, motor support assembly 160 comprises a base plate or end wall 44, a pair of laterally spaced apart upright members 180 welded thereto, and a top plate 182 bridging the members 180 and secured thereto by bolts 183. A pair of laterally spaced apart elongated guide members 185 are welded to the inside of the members 180.

Hydralulic motor 50 has its housing 186 rigidly secured to a guide plate 187 which has notches 188 therein which slidably engage the guide members 185. Hydraulic motor 50 has its rotatable shaft 190 rigidly secured to a plate 191 which is releasably connected by bolts 165 to a plate 164 which is welded to the upper end of auger shaft 146. Thus, rotation of motor shaft 190 is transmitted to auger 46. Motor 50 has hydraulic fluid ports 197.

Hydraulic linear-type motor 51 comprises a cylinder 196 and a relatively extendable/retractable piston rod 198. The lower end of cylinder 196 in connected by a pivot pin 200 to housing 186 of motor 50. The upper end of piston rod 198 is connected by a pivot pin 202 to top plate 182 of motor support assembly 160. Thus, extension and retraction motion of ram-type motor 51 is transmitted to auger 46. Motor 51 has hydraulic fluid ports 204.

As is apparent from the foregoing description, crater sink mechanism 26 is readily disassembled and re-assembled for servicing and replacement of its component parts.

Figure 8:
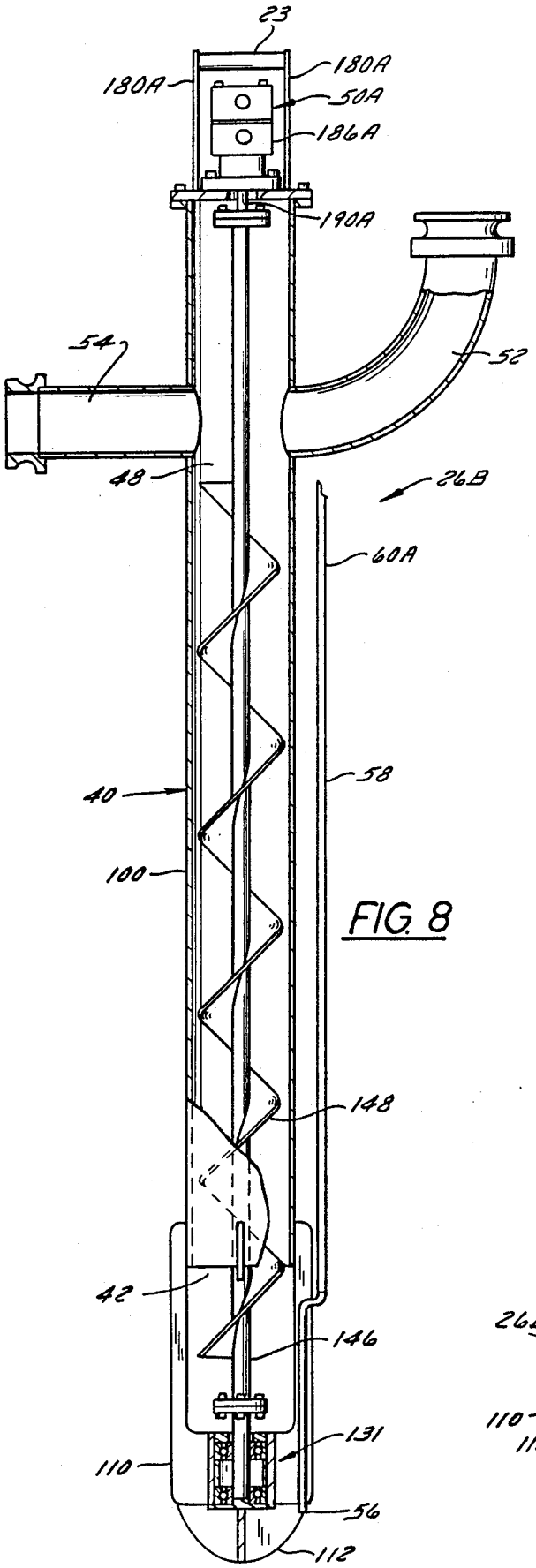
FIG. 8 is a cross-section view of another simpler embodiment of a crater sink mechanism in accordance with the invention in which the auger is not axially shiftable.
Figure 10:
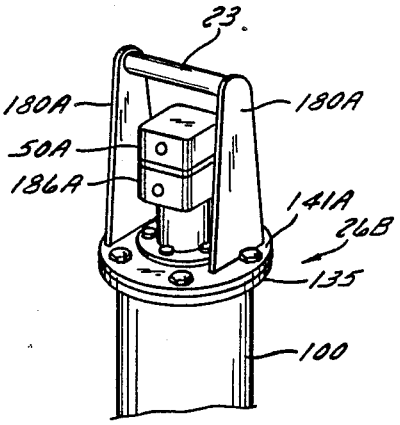
Figure 9:
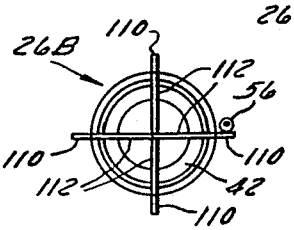
FIG. 9 is a plan view of the lower end of the crater sink mechanism of FIG. 8.

The crater sink mechanism 26B shown in FIGS. 8, 9 and 10 is generally similar to mechanism 26 heretofore described but is simpler in construction and mode of operation in that it is not provided with an extension/retraction motor 51 for its auger 46B, which is reversably rotatably but not axially shiftable, and is not provided with separate bearing cleaning means, but relies instead on clear water from jet nozzle 56.

Figure 1A:
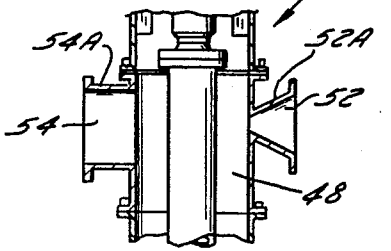

The crater sink mechanism 26A shown in FIGS. 1, 1A and 2B is generally similar to mechanism 26 hereinbefore described but differs therefrom in that the clear water inlet port 52 takes the form of (or includes) the flow constricting eductor nozzle 52A and the mixture outlet port 54 takes the form of (or includes) a relatively wide flow expansion nozzle 54A.

APPARATUS AND SYSTEMS FIRST SYSTEM

Referring to FIGS. 1 and 1A, there is shown a first dredging system and apparatus comprising submersible crater sink mechanism 26A; pump means comprising a motor-driven pump mechanism 28 for supplying clear water 20 under pressure to crater sink mechanism 26A and for expelling a mixture 18 of clear water 20 and particulate material 22 therefrom and onto containment area 24; power supply means 30 for operating crater sink mechanism 26A and pump mechanism 28; and control means 32A for controlling operation of crater sink mechanism 26A and other system components.

Motor driven pump mechanism 28 comprises a centrifugal water pump 70 having an inlet port 72 and an outlet port 74 and a hydraulic motor 76 for driving pump 70. Pump 70 and motor 76 are mounted on a trailer 78 for portability purposes, but if convenient, could be mounted on a boat or barge (not shown) which floats on the body of water 16. Pump inlet port 72 is connected by a clear water inlet hose 80 to receive clear water from the body of water 16, as from a location remote from the dredging site. Pump outlet port 74 is connected by hose 29 to clear water inlet conduit 52 of crater sink mechanism 26. Mixture outlet conduit 54 of crater sink mechanism 26 is connected by discharge hose 89 to containment area 24.

As FIG. 1 shows, power supply means 30 comprises a hydraulic pump 82 driven by an internal combustion engine 84 and having a pair of hydraulic fluid lines 86 and 88 for supplying hydraulic pump motor 76, a pair of hydraulic fluid lines 86A and 88A for supplying hydraulic auger drive motor 50 and a pair of hydraulic fluid lines 86B and 88B for supplying hydraulic auger shift motor 51. Pump 82 and engine 84 are mounted on a trailer 90 for portability purposes, but if convenient, could be mounted on a boat or barge (not shown) which floats on the body of water 16.

The control means 32A are shown as mounted on trailer 90 of power supply means 30 but, if convenient, could be located elsewhere.

Referring to FIG. 1, the first system generally operates as follows. It assures that crater sink mechanism 26A is emplaced as shown in FIG. 1, and that auger 46 is extended for a desired distance and is rotating in the ingesting direction. Pump 70 draws clear water through hose 80 and supplies it under pressure through hose 29 to inlet port nozzle 52A of crater sink mechanism. The clear water flows from clear water inlet port 52, through mixing chamber 48 and out through enlarged mixture outlet nozzle 54A. The hydraulic pressure in chamber 48 is within the limits hereinbefore described, because of the shape of the nozzles 52A and 54A and chamber 48, and material ingested through material intake opening 42 by auger 48 enters chamber 48 wherein it is mixed with incoming clear water. The mixture 18 is then forced out of chamber 48 through nozzles 54A and through hose 89 connected thereto to disposal site 24.

SECOND SYSTEM

Referring to FIGS. 2 and 7, there is shown a second dredging system comprising submersible crater sink mechanism 26; pump means comprising a motor driven pump mechanism 28A including dredge pump 70A and its drive motor 76A; and control means 32A shown in FIG. 7. It is to be understood that certain components schematically shown in FIG. 7 are similar to those depicted in FIG. 1 and could be mounted on trailer 90 as shown and explained in connection with FIG. 1.

The second dredging system operates as follows. The shape and weight of crater sink mechanism 26, the digging action of auger 46, and the displacement of material 14 dislodged from crater floor 12 cooperate to enable the crater sink mechanism to dig vertically downwardly into the material 14 defining the crater floor and to descend along with the floor of the crater as the latter is being formed and deepened.

The control means 32 for the improved crater sink senses when large foreign objects (not shown), such as sticks and stones, in the dredged material 14 enter opening 42 in housing 40 and impose undue loads on auger 46 and apparatus motor 50 accordingly, as hereinafter explained.

Referring to FIG. 7, control means 32A for crater sink mechanism 26 comprises conventional manually-operable three-position (neutral, forward, reverse) proportional hydraulic control valves V1, V2, V3 and V4 for controlling fluid flow to dredge pump motor 76A, auger shift motor 51, auger rotation motor 50, and small clear water pump motor 63, respectively. Valve V3 operates to control the direction of rotation (forward or reverse) and speed of rotation of its motor 50. Valve V1 controls the speed of rotation of pump motor 76A. Valve V2 controls extension and retraction of ram motor 51 and the speed of such motion. Valve V4 controls small clear water pump motor 63.

Control means 32A further comprises an electronic control circuit 300 for receiving electric input signals from an electric condition sensing transducer or sensor 302 and for providing, under certain circumstances, electric control signals to an electric proportional solenoid actuator 304 for control valve V3 which operates auger rotation motor 50. Control circuit 300 also provides an alarm signal to an electrically operable alarm device 306. Operating power for circuit 300, actuator 304 and alarm 306 is supplied from, for example, a DC power source 308.

Transducer or sensor 302 takes the form of a known commercially available device which is connected to the hydraulic fluid lines 86C and 88C for motor 50 and senses the direction and rate of fluid flow therethrough to determine thereby both the direction of rotation and speed of rotation of motor 50 and, therefore, of auger 46. Electric input signals pertaining to direction and speed are transmitted from transducer 302 to sub-circuits 310 and 312, respectively, in control circuit 300 which process them and provide appropriate signal information to a central processing unit CPU in control circuit 300.

Control circuit 300 also comprises two timer circuits, namely: timer circuit 314 which measures the time interval of the overload, and timer circuit 316 which establishes the time interval or duration of reverse rotation. Control circuit 300 also comprises an event counter circuit 318 which counts the number of overload events which occur within a predetermined time span.

If load magnitude (based on hydraulic fluid pressure in whichever fluid line 86C and 88C is supplying fluid to motor 50) exceeds a certain predetermined pre-selected value for a predetermined interval of time, indicative of an excessive load on auger 46 caused by an unduly large foreign object in opening 42 in housing 40, central processing unit CPU provides an electric output signal to solenoid 304 to operate valve V3. Valve V3 is moved by solenoid 304 to the reverse condition in which it was initially set manually (i.e., forward position) and motor 50 and auger 46 reverse their direction of rotation for a predetermined interval of time, whereafter valve V3 is returned to its original forward position.

Control circuit 300 senses but ignores severe loads which exist for only a short interval of time (i.e., up to 2 seconds, for example), but effects reversal of rotation of auger 46 for a short period of time (i.e., about 5 seconds, for example) for a severe load which persists for a longer interval of time (i.e., longer than 2 seconds, for example). The control circuit 300 also senses the number of reversals (i.e., 3, for example) which occur within a selected interval of time (i.e., three minutes, for example) and either sounds alarm 306 to warn the operator of adverse dredging conditions or shuts off auger rotation motor 50 or does both.

THIRD SYSTEM

Referring to FIG. 2B, there is schematically shown a third dredging system comprising submersible crater sink mechanism 26A; pump means comprising two motor driven pumps 70 and 70A; and control means comprising the components shown in both FIGS. 1 and 7 hereinbefore described. The nozzles 52A and 54A operate as hereinbefore described to maintain proper hydraulic pressure in mixing chamber 48. The use of two pumps increases the load capacity of the system, which may be required in some dredging situations.

RECAPITULATION

It is apparent from the foregoing description that applicant's invention solves the problems of discharge line plugging and lack of production by ensuring a continuous flow of a mixture of dredged material of desired density in the following manner. (a) The pump (whether 70A, 70 or a combination of both) has continuous supply of clear water available; (b) it is possible to closely regulate the amount of solids that enters the material intake opening 42; (c) an adequate supply of material is made available to the system while in operation; and (d) a means is provided to handle debris and oversized material at the material intake opening.

Regarding (a) above, the unobstructed clear water inlet port is in communications with clear water at all times to thereby supply a constant source of water to the pump.

Regarding (b) above, the material input is introduced into the clear water flow in the chamber at a near uniform rate in order to regulate the specific gravity or density of the mixture or slurry. This can be accomplished in several ways, however, the auger is a very efficient and practical device. An important difference between the prior art manner of installing a material input device and applicant's present approach is as follows. The conventional prior art method is to insert a cutter head or other input device in series with and ahead of a pump suction inlet. However, this causes an inevitable series of events, i.e. loss of suction line velocity, pump cavitation, and velocity loss of the slurry in the discharge line which can lead to a line plug, if solids are present in the line. In the present invention the input device (auger) is parallel with the pump suction flow. Thus, if the auger is plugged, the pump still has full inlet flow of clear water available through the chamber. No velocity loss results in no plugged pipelines. The mixture or slurry density will drop to zero. However, as soon as the input device (auger) is cleared, the crater sink mechanism is back on line with production back to normal.

Regarding (c) above, the crater sink mechanism is designed with the ability to dig itself in, as it removes the material from the bed of material, to insure a continued material supply.

Regarding (d) above, the housing has guards to prevent larger debris from entering the material intake opening. The jet-type fluidizing device is employed to help material flow into the opening and it also allows the larger and heavier debris objects to sink below the auger input end. The crater sink also employs a reversing means which helps eliminate jamming. In addition to this, the linear motor which controls auger extension enables the crater sink mechanism to operate unattended for extended periods of time.

Figure 11:
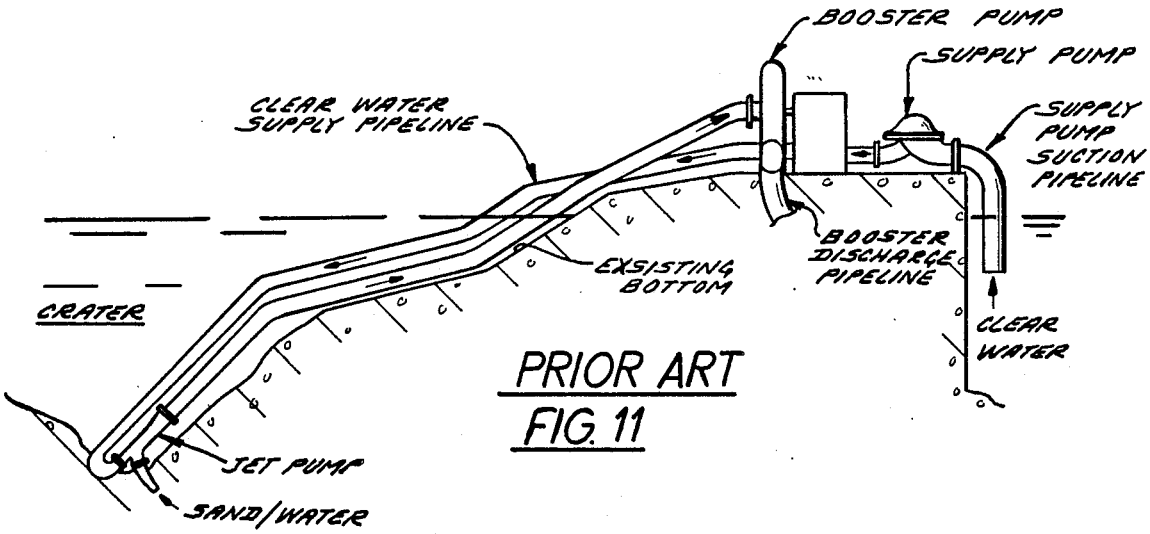
PRIOR ART FIG. 11
FIG. 11 is a schematic diagram of a prior art jet type pump and system.
Figure 12:
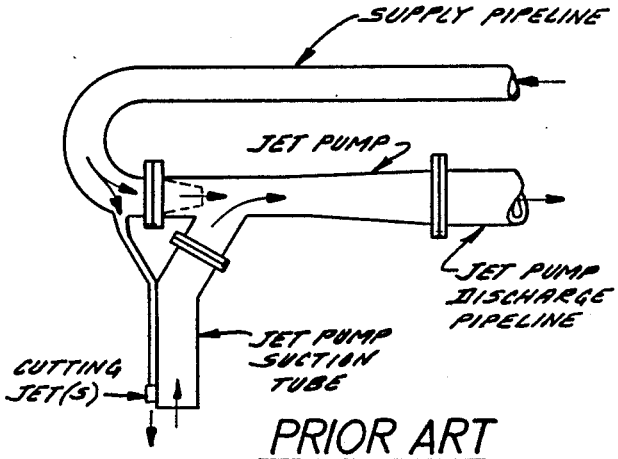
PRIOR ART FIG. 12
FIG. 12 is an enlarged cross-section view of the jet pump of FIG. 11.

The crater sink mechanism can be easily adapted to jet pump or to eductor pump types of dredging systems. As FIG. 1A shows, the eductor nozzle is installed at the clear water inlet port of the mixing chamber and clear drive water is supplied by a pump. The wide diffuser nozzle is located at the mixture outlet port of the mixing chamber. The main concern when using the foregoing arrangement is to keep the mixing chamber from going into cavitation. Unlike a standard prior art jet pump system (see FIG. 11 and 12), a low inlet pressure is not desirable because of the fact the material is delivered to the mixing chamber by the rotary auger and, if the pressure in the mixing chamber is too low, control of solids flow may be lost. If a booster pump is used in conjunction with a jet pump, no special equipment is necessary and the normal jet pump design criteria can be used for booster pump requirements.

I claim:

1. A dredging apparatus for forming a crater in a bed of material beneath a body of water comprising:

a crater sink mechanism adapted to sink into said bed as said crater is being formed and comprising:

a housing defining a mixing chamber having a clear water inlet port, a mixture outlet port and a material intake opening for disposition beneath and in communication with said body of water adjacent said bed, that portion of said housing near said intake opening being adapted to enter said bed when said crater sink mechanism is in operation, said housing comprising an elongated tube which is generally vertically disposed with respect to said sea bed during operation of said crater sink mechanism;

and transport means in said housing near said material intake opening for continuously digging into said bed to dislodge material fluidized by ambient water therefrom for maintaining said dislodged material fluidized while transporting said fluidized material to said mixing chamber and for discharging said material while still fluidized from said mixing chamber through said mixture outlet port, and pump means separate from and exteriorly of said crater sink mechanism connected to at least one of said clear water inlet port and said mixture outlet port, said pump means being operable to effect flow of clear water through said clear water inlet port into said mixing chamber for mixing with said fluidized material in said mixing chamber to form a mixture and to effect flow of said mixture from said mixing chamber through said mixture outlet port, the hydraulic pressure in said mixing chamber relative to the ambient hydrostatic pressure of said body of water being such as to prevent substantial pressure-induced induction or blow-out of material through said material intake opening.

2. A dredging apparatus according to claim 1 wherein said pump means comprises a clear water supply pump connected to said clear water inlet port of said crater sink mechanism.

3. A dredging apparatus according to claim 1 further comprising control means for operating said transport means of said crater sink mechanism and said pump means.

4. A dredging apparatus according to claim 2 further comprising control means for operating said transport means of said crater sink mechanism and said pump means.

5. A crater sink mechanism for use in a dredging apparatus to form a crater in a bed of material beneath of body of water and operable to sink into said crater as the latter forms, said mechanism comprising:

a housing defining a mixing chamber having a clear water inlet port, a mixture outlet port and a material intake opening for disposition beneath said body of water adjacent said bed, that portion of said housing near said intake opening being adapted to enter said bed when said crater sink mechanism is in operation, said housing comprising an elongated tube which is generally vertically disposed with respect to said bed during operation of said crater sink mechanism;

and transport means in said housing near said material intake opening for continuously digging into said bed to dislodge material fluidized by ambient water therefrom for maintaining said dislodged material fluidized while transporting said fluidized material to said mixing chamber and for discharging said material while still fluidized from said mixing chamber through said mixture outlet port;

said clear water inlet port admitting a flow of clear water into said mixing chamber for mixing with said fluidized material in said mixture chamber to form a mixture, said mixture outlet port enabling a flow of said mixture from said mixture chamber, the mixture in said mixing chamber having a hydraulic pressure relative to ambient hydrostatic pressure of said body of water such as to prevent substantial pressure-induced induction or blow-out of material through said material intake opening.

6. A crater sink mechanism according to claim 5 wherein said transport means comprises movable means operable to dig and transport said material and a drive motor to operate said means.

7. A crater sink mechanism according to claim 6 wherein said movable means comprises a rotatable auger and said drive motor operates to effect rotation of said auger.

8. A crater sink mechanism according to claim 7 wherein said drive motor is reversible and is selectively operable to rotate said auger in one direction wherein it ingests material into said material intake opening and in another direction wherein it expels ingested material from said material intake opening.

9. A crater sink mechanism for use in a dredging system to form a crater in a bed of material beneath a body of water and operable to sink into said crater as the latter forms, said mechanism comprising;

a tubular housing having a material intake opening at one end and closed at its opposite end, said housing being adapted for vertical disposition with respect to said bed when in use so that said material intake opening is submerged, and confronts said bed, that portion of said housing near said intake opening being adapted to enter said bed when said crater sink mechanism is in operation;

an auger means rotatably mounted in said housing near said material intake opening for continuously digging into said bed to dislodge material fluidized by ambient water therefrom and for maintaining said dislodged material fluidized while transporting said fluidized material within said housing, said auger means cooperating with said housing to define a mixing chamber between said auger means and the closed end of said housing;

means on said housing to rotate said auger means whereby said auger means digs into and ingests material from said bed through said material intake opening and transports said ingested material in a fluidized condition into said mixing chamber;

a clear water inlet port in said housing communicating with said mixing chamber for admitting clear water into said mixing chamber for mixing with said ingested fluidized material in said mixing chamber to provide a mixture of clear water and ingested fluidized material;

and a mixture outlet port in said housing communicating with said mixing chamber and through which said mixture is expelled from said mixing chamber for disposal at a remote location.

10. A crater sink mechanism according to claim 9 further comprising a jet nozzle located near said material intake opening and means to supply clear water to said nozzle for injection into material being ingested by said auger to fluidize said ingested material and facilitate its transport by said auger within said housing to said mixing chamber.

11. A method of forming a crater in a bed of material beneath a body of water comprising the steps of:

providing a housing defining a mixing chamber having a clear water inlet port, a mixture outlet port, a material intake opening and transport means rotatably mounted within said housing;

disposing said housing vertically with respect to said sea bed so that said material intake opening is beneath said body of water adjacent said bed;

operating said transport means to dig into said bed to dislodge material fluidized by ambient water from said bed, and transporting said dislodged material while fluidized by ambient water into said mixing chamber; and operating said housing to continuously dig into said bed as said crater is formed;

effecting flow of clear water through said clear water inlet port into said mixing chamber for mixing with said fluidized material in said mixing chamber to form a mixture;

effecting flow of said mixture from said mixing chamber through said mixture outlet port;

and maintaining the hydraulic pressure of said mixture in said mixing chamber relative to the hydrostatic pressure of said body of water so as to prevent pressure-induced induction and expulsion of dislodged material through said material intake opening.

12. A method of forming a crater in a bed of material beneath a body of water comprising the steps of:

providing a housing defining a mixing chamber having a clear water inlet port, a mixture outlet port and a material intake opening for disposition beneath said body of water adjacent said bed, said housing comprising an elongated tube which is generally vertically disposed with respect to said bed during operation of said crater sink mechanism;

providing operable transport means in said housing near said material intake opening and operating said transport means to dig downward into said bed, to dislodge material fluidized by ambient water from said bed and to maintain said dislodged material fluidized while transporting said fluidized material from said material intake opening into said mixing chamber;

effecting flow of clear water through said clear water inlet port into said mixing chamber for mixing with said fluidized dislodged material in said mixing chamber to form a mixture;

effecting flow of said mixture from said mixing chamber through said mixture outlet port;

and maintaining the hydraulic pressure of said mixture in said mixing chamber relative to the hydraulic pressure of said body of water so as to prevent pressure-induced induction and expulsion of dislodged material through said material intake opening.

13. A method according to claim 12 wherein said transport means comprises a rotatable auger and a reversible drive motor for rotating said auger in one direction to effect ingestion of material and for rotating said auger in the opposite direction to effect expulsion of material.

* * * * *